US010141681B2

(12) United States Patent
Shindo

(10) Patent No.: US 10,141,681 B2
(45) Date of Patent: Nov. 27, 2018

(54) WATERPROOF CONNECTOR

(71) Applicant: Tyco Electronics Japan G.K., Kanagawa (JP)

(72) Inventor: Yoshihiko Shindo, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 15/684,598

(22) Filed: Aug. 23, 2017

(65) Prior Publication Data

US 2018/0062304 A1 Mar. 1, 2018

(30) Foreign Application Priority Data

Aug. 24, 2016 (JP) ..... 2016-163174

(51) Int. Cl.
*H01R 13/52* (2006.01)
*H01R 13/629* (2006.01)

(52) U.S. Cl.
CPC ... *H01R 13/5219* (2013.01); *H01R 13/62933* (2013.01)

(58) Field of Classification Search
CPC . H01R 13/5219; H01R 13/5202; H01R 13/52
USPC ..... 439/271
See application file for complete search history.

(56) References Cited

U.S. PATENT DOCUMENTS 5,575,672 A * 11/1996 Katsuma ..... B60T 8/368 439/157
6,354,852 B2 * 3/2002 Noro ..... H01R 13/62938 439/157
7,052,293 B2 * 5/2006 Koshy ..... H01R 13/533 439/157
7,252,547 B2 8/2007 Nishide
8,777,648 B2 * 7/2014 Kitajima ..... H01R 13/5202 439/271
2001/0044228 A1 * 11/2001 Noro ..... H01R 13/62938 439/157
2004/0209503 A1 * 10/2004 Fukamachi ..... H01R 13/62938 439/157
2013/0323954 A1 * 12/2013 Eckel ..... H01R 13/5219 439/271
2014/0065865 A1 * 3/2014 Mizutani ..... H01R 13/4365 439/271
2015/0140847 A1 * 5/2015 Kanemura ..... H01R 13/4368 439/259

FOREIGN PATENT DOCUMENTS

JP 2011222224 A 11/2011

OTHER PUBLICATIONS

Abstract of JP2011222224, dated Nov. 4, 2011, 2 pages.

* cited by examiner

*Primary Examiner* — Harshad C Patel
(74) *Attorney, Agent, or Firm* — Barley Snyder

(57) ABSTRACT

A waterproof connector comprises a housing, a waterproof member, and a lever. The waterproof member surrounds and contacts a sidewall of the housing over an entire circumference of the sidewall. The lever is movable between an unmated position and a mated position. In the mated position of the lever, the lever and the housing together cover the waterproof member over an entire circumference of the waterproof member.

7 Claims, 8 Drawing Sheets

WATERPROOF CONNECTOR

CROSS-REFERENCE TO RELATED APPLICATION

This application claims the benefit of the filing date under 35 U.S.C. § 119(a)-(d) of Japanese Patent Application No. 2016-163174, filed on Aug. 24, 2016.

FIELD OF THE INVENTION

The present invention relates to an electrical connector and, more particularly, to a waterproof connector.

BACKGROUND

Known waterproof connectors have a waterproof member surrounding and contacting a sidewall of a housing over an entire circumference of the housing. When a mating connector is mated with the waterproof connector, the waterproof member also comes into contact with an inner wall face of the mating connector, ensuring water-tightness. If dust adheres to the waterproof member when the mating connector is not mated with the waterproof connector, the waterproofness after the mating connector is mated with the lever type waterproof connector might be impaired.

In order to prevent dust from adhering to the waterproof member when not mated with the mating connector, known waterproof connectors have a cover or the like covering the waterproof member. However, when this cover is provided, the size of the waterproof connector increases. Further, if the waterproof connector has a lever to facilitate mating with the mating connector, the lever might further increase the size of the waterproof connector.

Japanese Patent Application No. 2006-302769A discloses a waterproof connector having a lever without a cover. In the connector of JP 2006-302769A, since the lever is provided, a part of the waterproof member is covered with the lever but another part of the waterproof member remains exposed. Known waterproof connectors having a lever thus insufficiently prevent the adhesion of dust to the waterproof member.

SUMMARY

A waterproof connector according to the invention comprises a housing, a waterproof member, and a lever. The waterproof member surrounds and contacts a sidewall of the housing over an entire circumference of the sidewall. The lever is movable between an unmated position and a mated position. In the mated position of the lever, the lever and the housing together cover the waterproof member over an entire circumference of the waterproof member.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
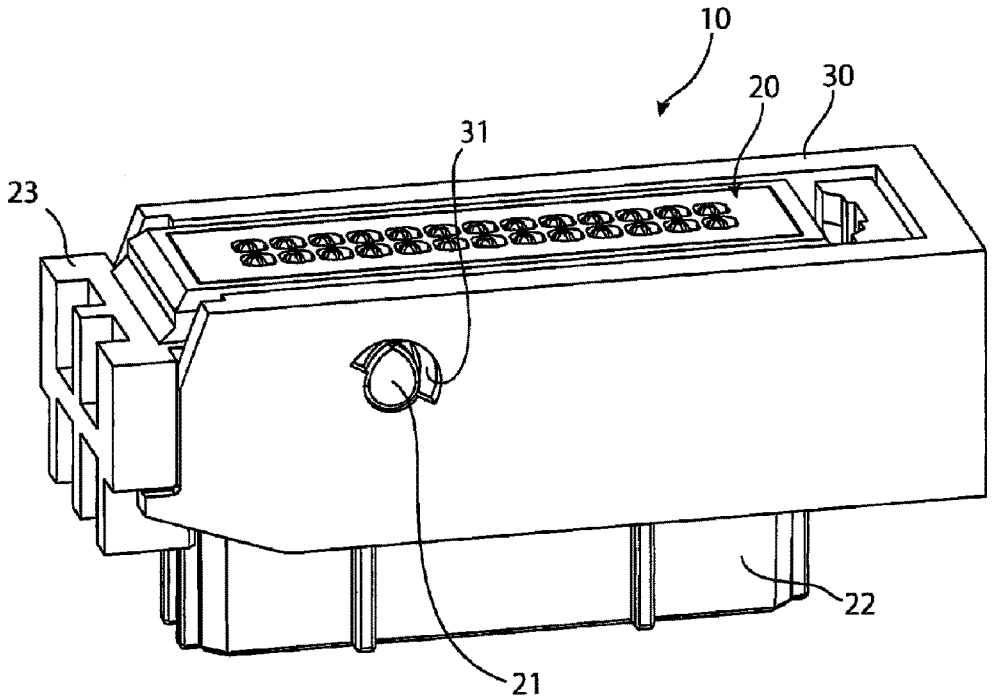
FIG. 1 is a top perspective view of a waterproof connector according to the invention in a mated position.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
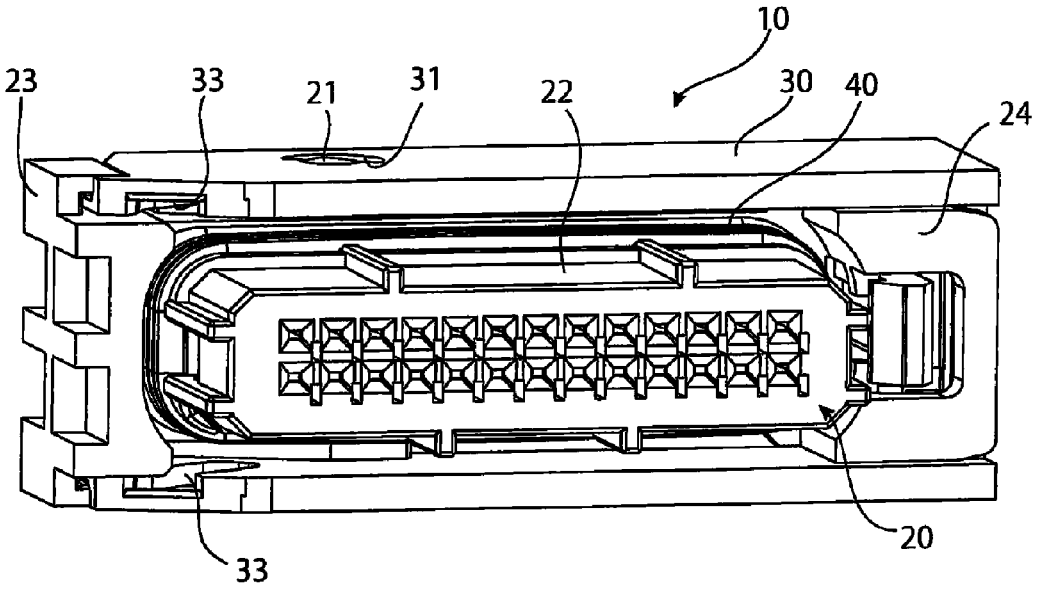
FIG. 2 is a bottom perspective view of the waterproof connector in the mated position.
Figure 3:
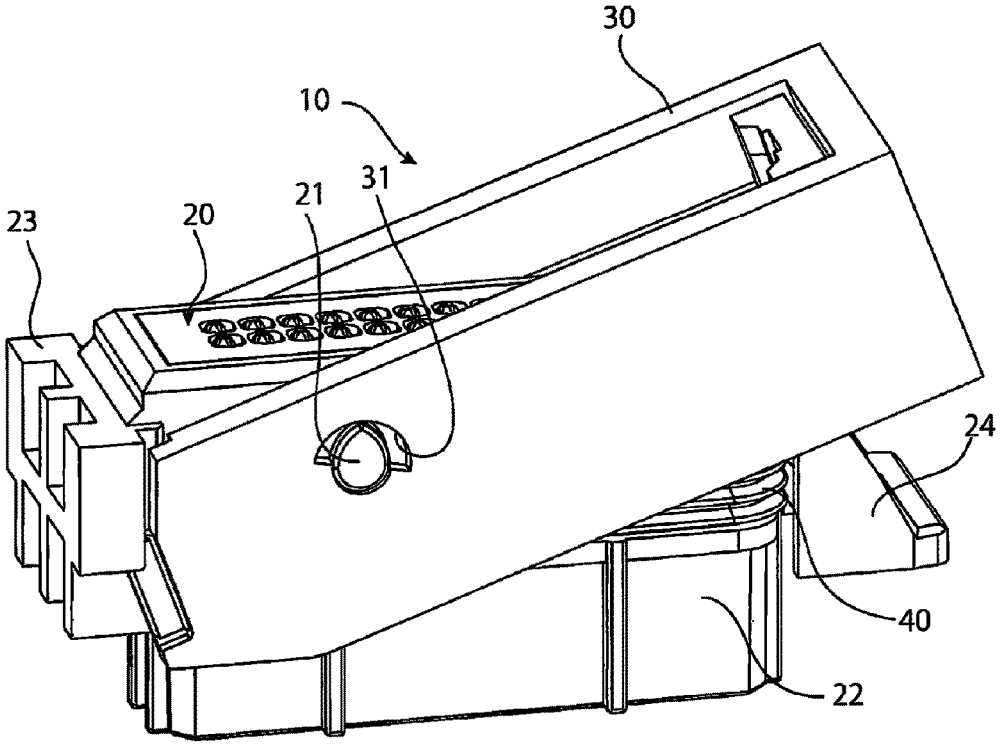
FIG. 3 is a top perspective of the waterproof connector in an unmated position.

A waterproof connector 10 according to the invention is shown in FIGS. 1-3. The waterproof connector 10 includes a housing 20, a lever 30, and a waterproof member 40.

The lever 30, as shown in FIG. 1, has a pair of passageways 31 extending through the lever 30 and serving as a pivot point around which the lever 30 can rotate. A pair of projections 21 provided on both opposite side faces of the housing 20 are inserted in the passageways 31. The lever 30 rotates between a mated position shown in FIGS. 1 and 2 and an unmated position shown in FIG. 3. The lever 30 has, as shown in FIG. 2, a plurality of cam grooves 33 disposed on a bottom of the lever 30.

The waterproof member 40, as shown in FIGS. 1-3, surrounds a sidewall 22 of the housing 20 over an entire circumference of the housing 20 while contacting the sidewall 22. The lever 30 partially exposes the waterproof member 40 when it is in the unmated position shown in FIG. 3. However, when in the mated position shown in FIG. 1, the lever 30 is separated from the waterproof member 40 and faces the sidewall 22 such that the lever 30 covers the waterproof member 40 over an entire circumference of the waterproof member 40 between the lever 30 and the sidewall 22 in cooperation with the housing 20. That is, when in the mated position, the lever 30 covers the waterproof member 40 over the entire circumference of the waterproof member 40 in cooperation with the housing 20.

The housing 20, as shown in FIGS. 1-3, has a substantially rectangular shape with a pair of opposite short sides and a pair of opposite long sides. The housing 20 has a pair of covers 23, 24 disposed on the pair of opposite short sides of the rectangular shape. The covers 23, 24 are separated from the waterproof member 40 and face a sidewall 22 of the housing 20 such that the covers 23, 24 hold the waterproof member 40 between the covers 23, 24 and the sidewall 22; portions of the waterproof member 40 on the short sides of the housing 20 are covered with the covers 23, 24. In the mated position, the lever 30 serves to cover mainly portions of the waterproof member 40 on the long sides of the housing 20.

Figure 4:
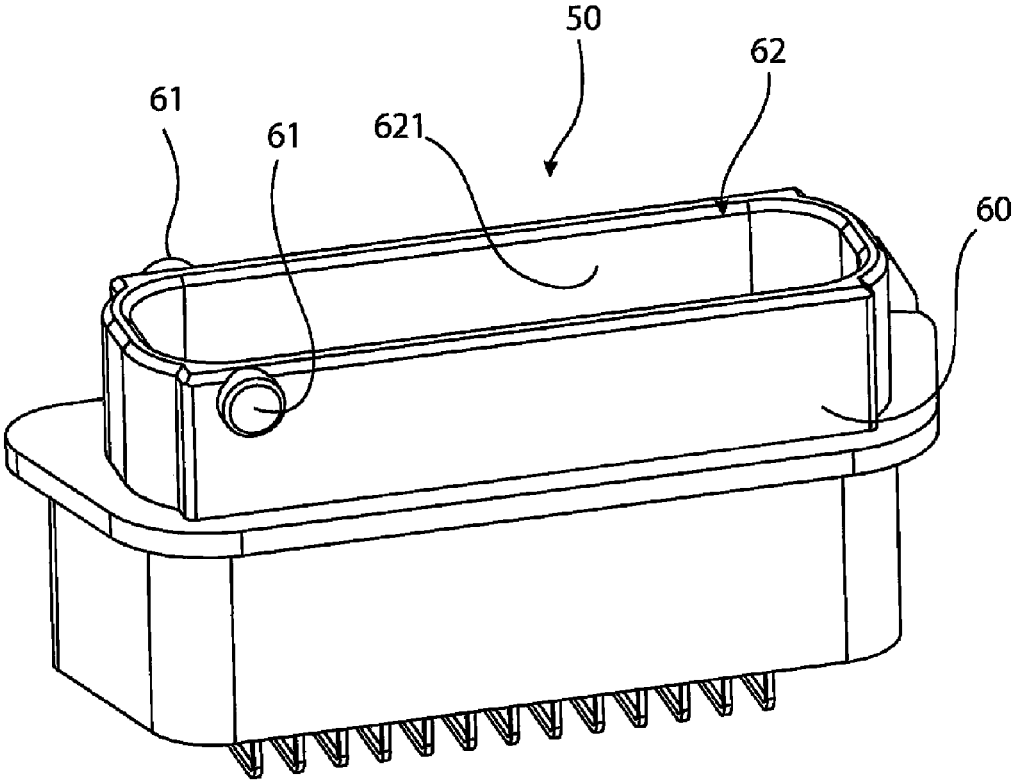
FIG. 4 is a perspective view of a mating connector.
Figure 5:
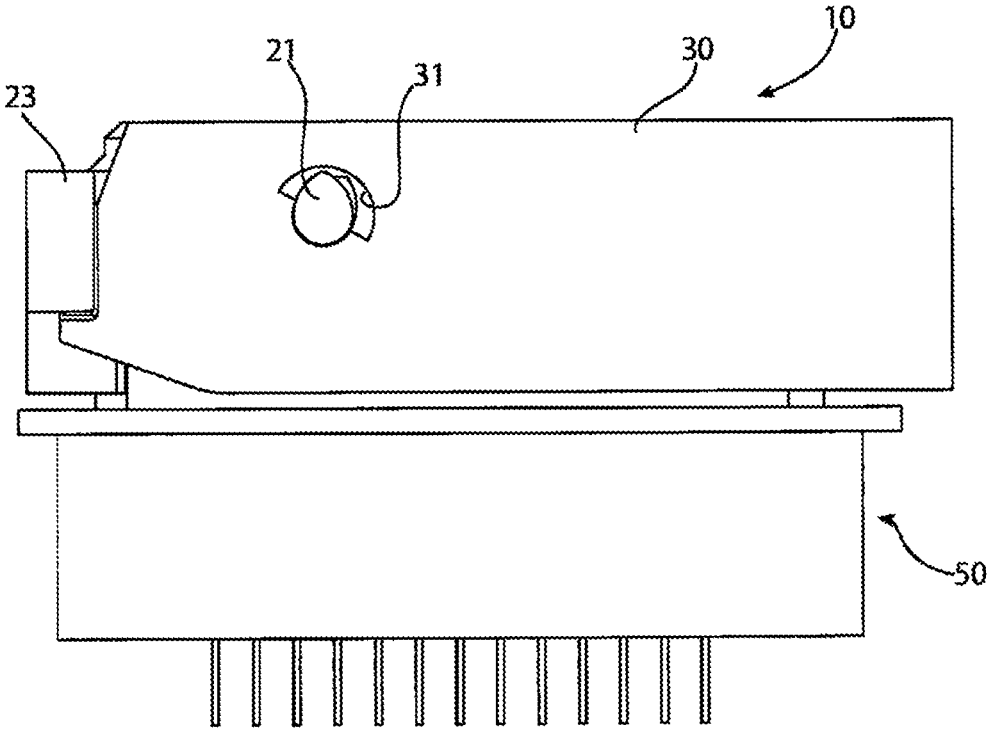
FIG. 5 is a side view of the waterproof connector of FIG. 1 and the mating connector of FIG. 4 in a mated state.
Figure 6:
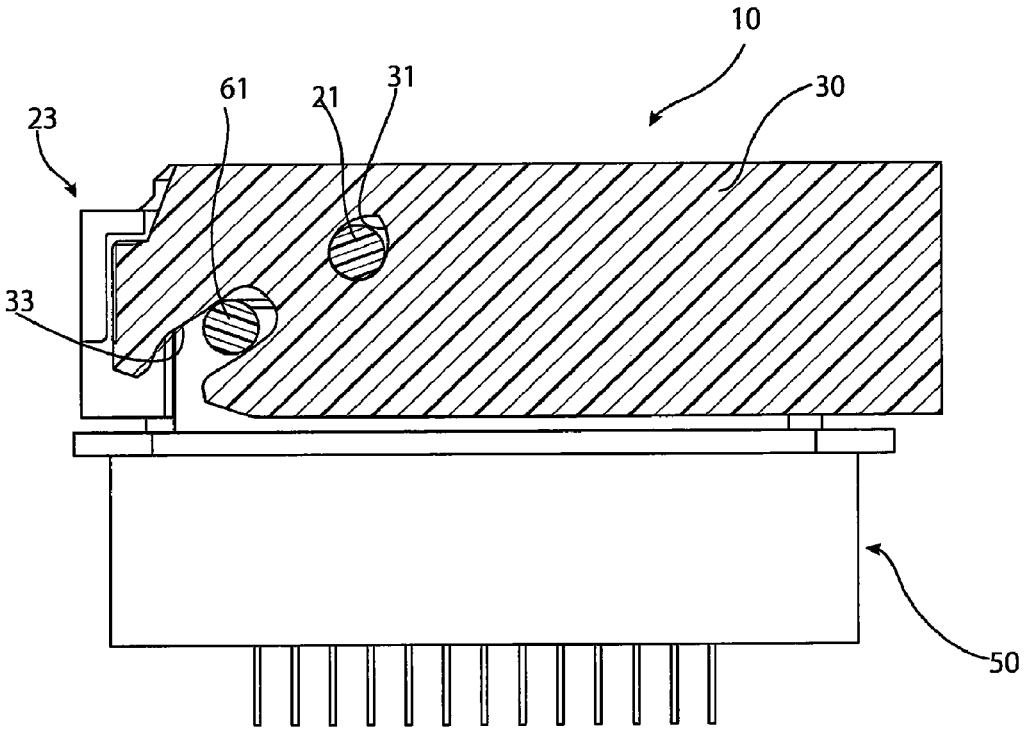
FIG. 6 is a sectional side view of the waterproof connector of FIG. 1 and the mating connector of FIG. 4 in the mated state.

A mating connector 50 matable with the waterproof connector 10 is shown in FIG. 4. The mating connector 50 has a mating housing 60. A pair of cam followers 61 project from opposite side faces of the mating housing 60. The mating housing 60 has an open-topped cylindrical mating portion 62 including an inner wall face 621 disposed on a side of the cylindrical mating portion 62 opposite the cam followers 61.

The mating of the waterproof connector 10 with the mating connector 50 will now be described with reference to FIG. 5-8.

With the lever 30 in the unmated position shown in FIG. 3 and the waterproof connector 10 in an unmated state with the mating connector 50, the waterproof connector 10 is inserted into the mating connector. Each cam follower 61 of the mating housing 60 is inserted into one cam groove 33 of the lever 30. Thereafter, the lever 30 is turned to the mated position shown in FIGS. 1 and 2. With this turning, the cam follower 61 is pulled deeper into the cam groove 33 and the waterproof connector 10 is mated to the mating connector 50 in a mated state shown in FIGS. 5-8. In the mated state, the lever 30 is located in a mated position. The lever 30 is also kept in the mated position at distribution and storage stages before actual use.

Figure 7:
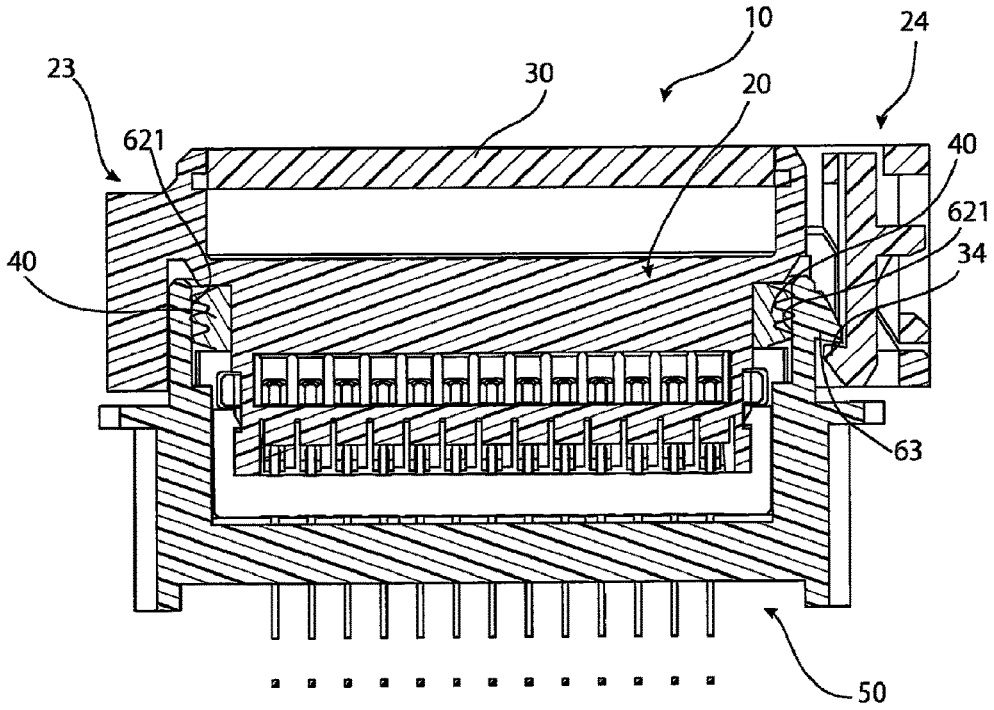
FIG. 7 is a longitudinal sectional side view of the waterproof connector of FIG. 1 and the mating connector of FIG. 4 in the mated state.
Figure 8:
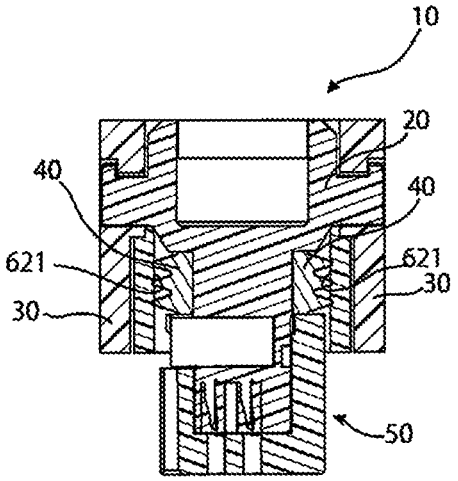
FIG. 8 is a transverse sectional side view of the waterproof connector of FIG. 1 and the mating connector of FIG. 4 in the mated state.

When the mating connector 50 is mated with the waterproof connector 10, as shown in FIGS. 7 and 8, the inner wall face 621 of the mating portion 62 comes into contact with the waterproof member 40 over an entire circumference of the inner wall face 621, forming a watertight seal. Thereby, waterproofness between the housing 20 of the waterproof connector 10 and the mating housing 60 of the mating connector 50 is ensured. Further, in the mated state, a hook portion 34 of the lever 30 catches a hook portion 63 provided on the housing 60 of the mating connector 50, locking the waterproof connector 10 and mating connector 50 in the mated state.

What is claimed is:

1. A connector, comprising:

a housing having:

a substantially rectangular shape with a pair of opposite short sides and a pair of opposite long sides, a pair of covers each disposed on one of the pair of opposite short sides; and a waterproof member surrounding and contacting a sidewall of the housing over an entire circumference of the sidewall and a portion of the waterproof member covered by each cover on the short side; and a lever movable between an unmated position and a mated position, the lever and the housing together covering the waterproof member over an entire circumference of the waterproof member in the mated position the lever covering a portion of the waterproof member on each of the opposite long sides and the housing not covering the waterproof member on each of the opposite long sides.

2. The connector of claim 1, wherein, in the mated position of the lever, the lever faces the sidewall and is separated from the waterproof member.

3. The connector of claim 2, wherein the waterproof member contacts an inner wall face of a mating connector mated to the connector.

4. The connector of claim 3, wherein the waterproof member forms a watertight seal between the connector and the mating connector.

5. The connector of claim 3, wherein, in the unmated position of the lever, the connector is an unmated state with the mating connector.

6. The connector of claim 5, wherein, in the mated position of the lever, the connector is in a mated state with the mating connector.

7. The connector of claim 1, wherein each cover faces the sidewall and is separated from the waterproof member.

* * * * *